US005797508A

United States Patent [19]

Loftus et al.

[11] Patent Number: 5,797,508

[45] Date of Patent: Aug. 25, 1998

[54] COLLAPSIBLE CONTAINER

[75] Inventors: Stephen Clive Loftus; Marcus Hoggarth, both of West Midlands, United Kingdom

[73] Assignee: McKechnie UK Limited, West Midlands, United Kingdom

[21] Appl. No.: 703,486

[22] Filed: Aug. 27, 1996

[51] Int. Cl.[6] ..... B65D 6/18

[52] U.S. Cl. ..... 220/6; 220/7

[58] Field of Search ..... 220/6, 7, 1.5

[56] References Cited

U.S. PATENT DOCUMENTS

| | | | |
|---|---|---|---|
| 4,044,910 | 8/1977 | Box | 220/7 |
| 4,098,409 | 7/1978 | Massey | 211/185 |
| 4,591,065 | 5/1986 | Foy | 220/6 X |
| 4,662,532 | 5/1987 | Anderson et al. | 220/7 |
| 4,809,851 | 3/1989 | Oestreich, Jr. | 206/599 |
| 4,820,383 | 4/1989 | Shchamorov et al. | 220/6 |
| 5,070,577 | 12/1991 | Bonneville et al. | 16/260 |
| 5,161,709 | 11/1992 | Oestreich, Jr. | 220/6 |
| 5,398,834 | 3/1995 | Umiker | 220/6 |

FOREIGN PATENT DOCUMENTS

| | | | |
|---|---|---|---|
| 197054 | 1/1986 | Australia . | |
| 570224 | 3/1988 | Australia | B65D 19/12 |
| 602 575 A2 | 12/1993 | European Pat. Off. | B65D 6/22 |
| 41 37 095 A1 | 5/1993 | Germany | B65D 6/16 |
| 233946 | 5/1925 | United Kingdom . | |
| 1398116 | 6/1975 | United Kingdom . | |
| WO 93/13991 | 7/1993 | WIPO | B65D 1/22 |
| 9518048 | 7/1995 | WIPO . | |

*Primary Examiner*—Steven M. Pollard
*Attorney, Agent, or Firm*—Adams Law Firm, P.A.

[57] ABSTRACT

Containers 10 have a base 12 and four side walls 14 which may fold to a stowed or collapsed position. Hinges connect each wall 14 to an intermediate member 16 which is clipped (preferably removably) to the base 12. Various interlocking formations 34, 36, 38, 40 allow containers to stack securely whether collapsed or erect.

24 Claims, 4 Drawing Sheets

COLLAPSIBLE CONTAINER

TECHNICAL FIELD AND BACKGROUND OF THE INVENTION

The present invention relates to collapsible containers.

Containers which can collapse to a more compact form when not in use are desirable for a number of situations, such as delivery of retail goods. Containers loaded with retail goods can be transported to the retailer, emptied, collapsed and then returned in their collapsed condition. This makes return transport easier by minimising the volume to be transported.

SUMMARY OF THE INVENTION

The invention provides a collapsible container comprising a base, at least one side wall which may move to a stowed position when the container is not in use, an intermediate member, hinge means connecting the intermediate member with a first one of the side wall and the base, and attachment means operable to attach the intermediate member to the second one of the side wall and the base, the intermediate member and the said second one of the side wall and the base being manufactured separately, and subsequently assembled by means of the attachment means.

Preferably the intermediate member extends along substantially the whole length of the side wall. The intermediate member may be located below the lower edge of the side wall, in use.

The attachment means may comprise cooperating formations such as cooperating projections and recesses. There may be detent means, preferably snap-together detent means, operable to retain the cooperating formations together. The cooperating formations may be brought together by movement of a first type, and subsequently moved to a locked condition by movement of a second type. The first and second types of movement may be movement in different, preferably perpendicular directions. The cooperating formations may comprise a hook formation for introduction into a projection in a first direction, movement in a second direction serving to engage the hook with the walls of the recess, thereby locking the projection and recess together. The attachment means may be detachable. The attachment means may incorporate resilience for retaining the attachment means in the attached condition.

The hinge means may comprise a live hinge.

Preferably the hinge means connects the intermediate member with the side wall, and the attachment means attaches the intermediate member to the base.

The base may have rectilinear shape and the container may comprise four side walls as aforesaid, and corresponding intermediate members connected and attached as aforesaid. The walls may fold over the base when the container is collapsed.

Preferably the container comprises stacking formations able to interlock with corresponding formations on a like container when the containers are in the erect or collapsed condition, and are stacked one on the other, the stacked containers being substantially prevented from relative movement by the interlocking of the stacking formations.

The invention also provides a collapsible container comprising a base, side walls having an erect condition and a collapsed condition, the container further comprising stacking formations able to interlock with corresponding formations on a like container when the containers are in the erect or collapsed condition and are stacked one on the other, the stacked containers being substantially prevented from relative movement by the interlocking of the stacking formations.

Preferably the side walls are connected to the base by hinge means. The side walls preferably lie across the base when in the collapsed condition.

The stacking formations may comprise projections and recesses. The stacking formations are preferably arranged to prevent containers sliding one on the other when stacked. The stacking formations may comprise castellations along wall edges which are uppermost when the container is in the erect condition and/or castellations located along the lower face of the base and/or recesses or depressions in the face and/or edges of the walls, the recesses or depressions being exposed from above when the container is in the collapsed condition, to receive castellations formed on the base of a like container.

Preferably the stacking formations allow containers to be stacked as aforesaid in a plurality of relative orientations, preferably orientations at right angles to each other.

The side walls may move to the collapsed condition when the container is not in use and the container may comprise an intermediate member, hinge means connecting the intermediate member with one of the side wall and the base, and attachment means operable to attach the intermediate member to the other of the side wall and the base, the intermediate member and the said other of the side wall and the base being manufactured separately and subsequently assembled by means of the attachment means.

BRIEF DESCRIPTION OF THE DRAWINGS

It will be apparent from the following description that the features of the first aspect of the invention set out above can be used along with the features of the second aspect of the invention as set out above, in various combinations.

Embodiments of the present invention will now be described in more detail, by way of example only, and with reference to the accompanying drawings, in which.

DESCRIPTION OF THE PREFERRED EMBODIMENT AND BEST MODE

Figure 1:
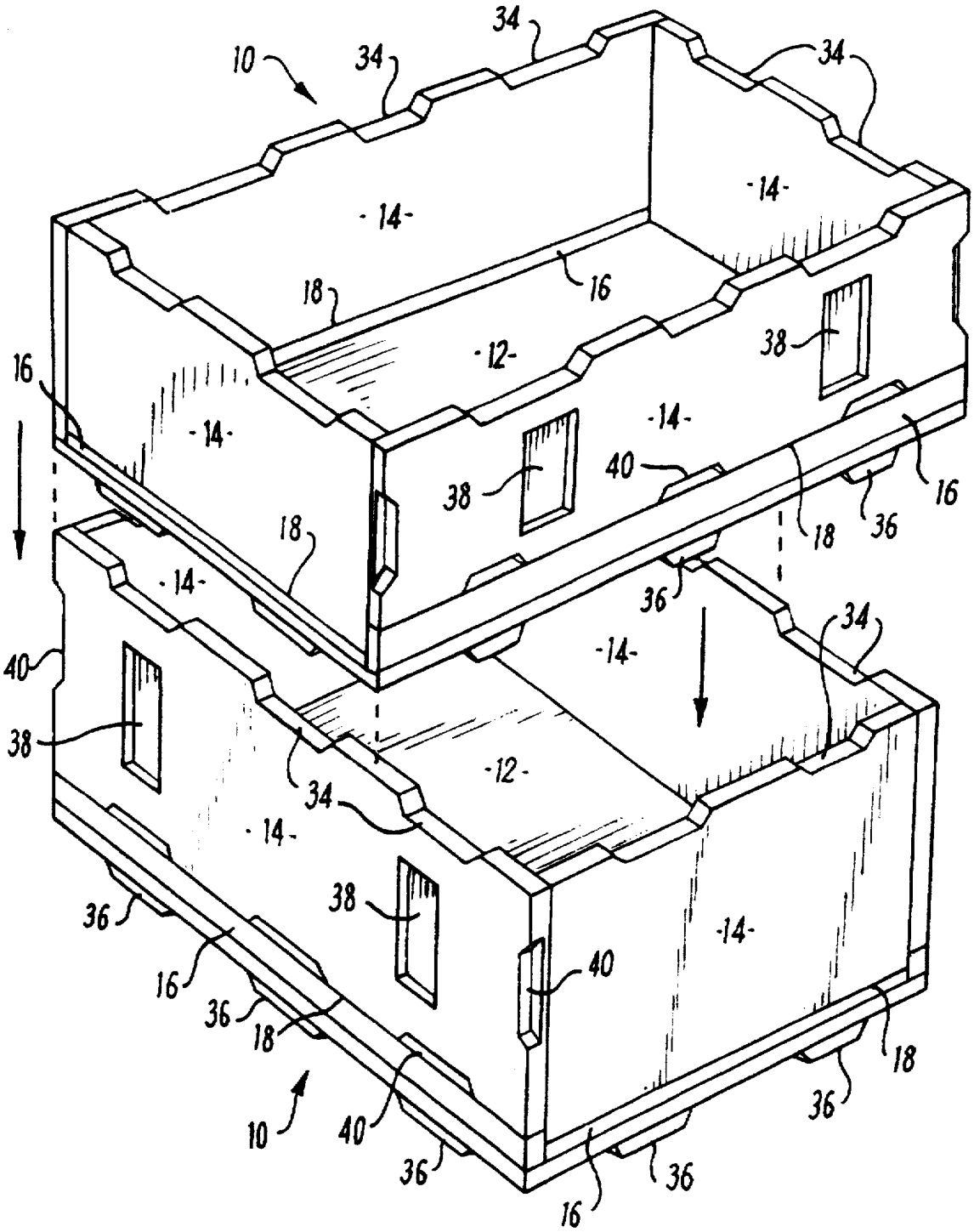
FIG. 1 is a schematic perspective view of two containers according to the invention, being stacked in their erect condition.

Referring to the figures, there is shown in FIG. 1 two collapsible containers 10 each comprising a base 12, four side walls 14 which may fold to a stowed or collapsed position (shown in FIG. 5) when the container is not in use. Each side wall 14 is associated with an intermediate member 16. Hinge means connect (in this example) each intermediate member 16 with the corresponding side wall 14. Attachment means (to be described in relation to FIG. 2) attach the intermediate members 16 to the base 12. The intermediate members 16 and the base are manufactured separately and subsequently assembled by means of the attachment means to be described.

In more detail, each container 10 has a generally rectangular base 12 from which the four side walls 14 extend upwardly when the container is in the erect condition, to form a generally parallelepipedal container with an open top. In the example shown, which has a base of approximately 600 mm×400 mm, one pair of opposed side walls is shorter than the other pair of opposed side walls.

Each side wall is connected along its lower edge 18 to the corresponding intermediate member 16 which runs along the whole length of the wall 14. The connection is by means of a "live" hinge, that is, a thin web 19 (FIG. 4) of material connecting the wall 14 and member 16 and sufficiently thin to flex, allowing the wall 14 to hinge relative to the member 16. Preferably, the various components of the container are manufactured in a plastics material, preferably by injection moulding. The side wall and intermediate member can therefore be manufactured as a single element having much reduced thickness at the hinge 19.

Figure 3:
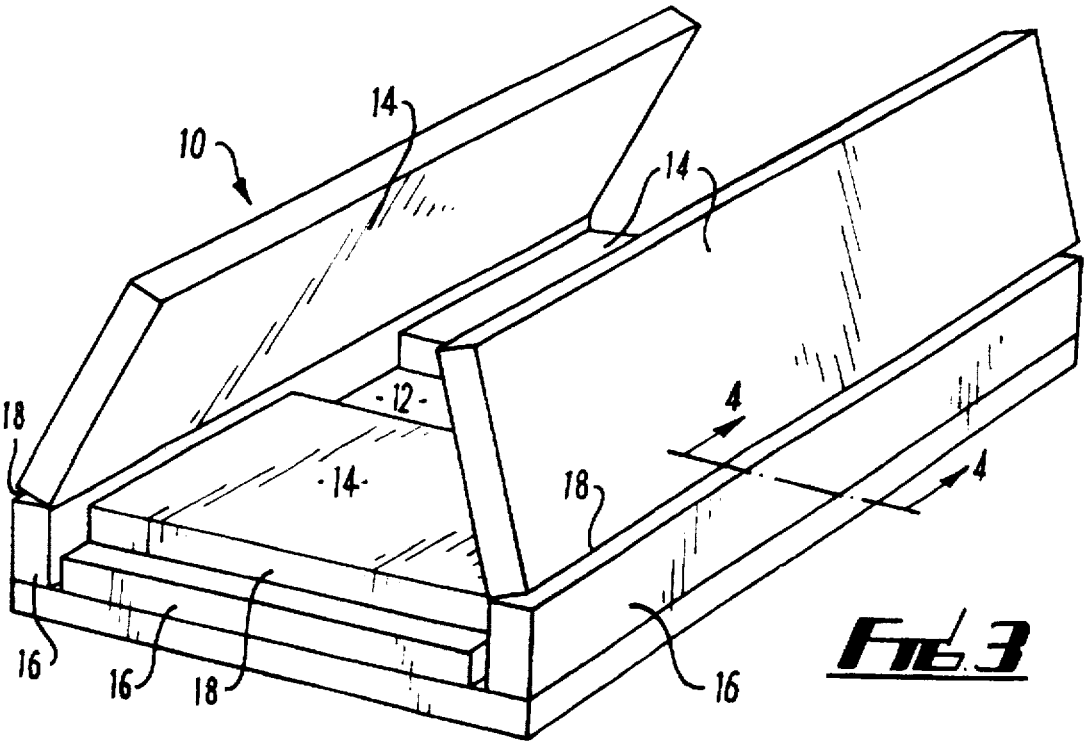
FIG. 3 is a highly schematic perspective view of the container of FIG. 2 in the partially collapsed condition.

When the container is in the erect condition, the side walls 14 stand on the intermediate members 16. However, the container 10 can be collapsed in the manner indicated in FIG. 3. The two shorter walls 14 are first folded toward each other to lie across the base 12. FIG. 3 shows the shorter walls fully folded to this stowed position. It is to be noted that the height of the intermediate members under the shorter walls is less than the height of the intermediate members under the longer walls so that in the position shown in FIG. 3, the upper face of the shorter walls is at or below the line of the hinges connecting the longer walls to their corresponding intermediate members. This allows the longer walls to be folded toward each other, down across the base and over the shorter walls. The container is then in the collapsed position shown in FIG. 5, which also shows additional features to be described below.

Figure 2:
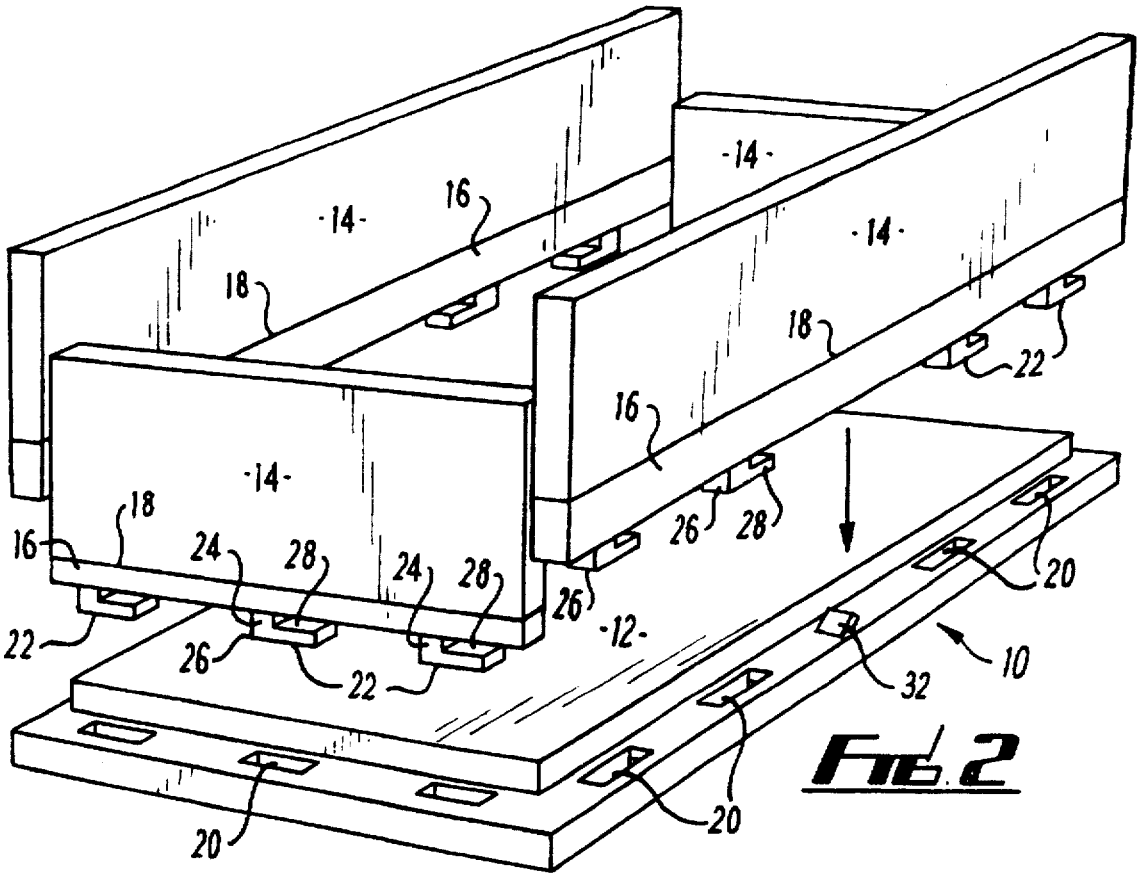
FIG. 2 is a more schematic exploded view of one of the containers of FIG. 1.
Figure 4:
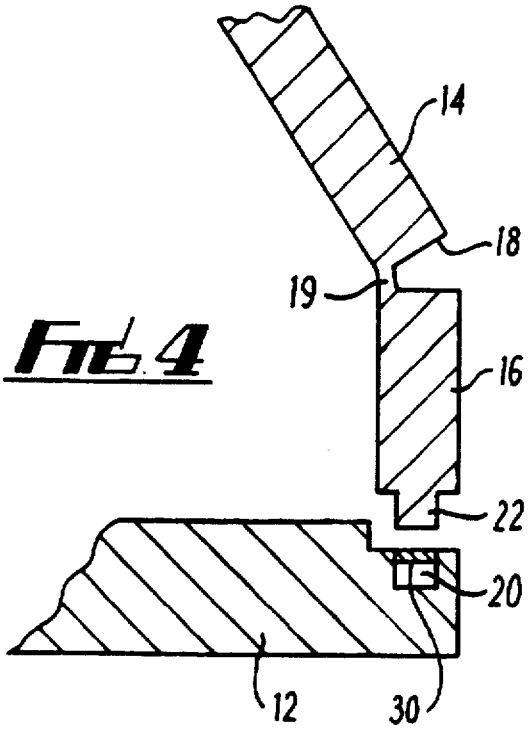
FIG. 4 is an exploded section along the line IV—IV in FIG. 2.

The intermediate members 16 are attached to the base 12 by a series of recesses 20 and projections 22 shown in FIGS. 2 and 4. Each projection 22 is generally L-shaped to form a hook having a short downwardly extending limb 24 finishing at an elbow 26, from which a generally horizontal and relatively long limb 28 extends away parallel to the length of the member 16.

The recesses 20 are generally rectangular and aligned parallel with the intermediate members 16. Their length corresponds with the length of the limb 28. This allows the members 16 to be lowered to introduce the limbs 28 into the recesses 20, whereupon the members 16 can be slid sideways parallel to the length of the members 16, to hook the long limbs 28 under corresponding surfaces 30 (FIG. 4) within the recesses 20. Alternatively, the second movement could be in a different direction, such as twisting.

There are preferably detent means associated with the recesses and projections to hold them together once connected. These may be permanent, but are preferably releasable to allow an intermediate member 16 to be removed by reversing the sequence of operations described above. This allows an intermediate member 16 and the corresponding side wall 14 to be removed and replaced, for instance to repair damage.

Arrangements for holding the intermediate member 16 and base 12 together may be resilient as indicated in FIG. 2, in which a small resilient upstand 32 projects above the surface of the base 12, to be pushed down when the intermediate member 16 is lowered into position. The resilience of the upstand 32 causes it to push the intermediate members 16 upwardly after connection to the base, thereby increasing friction between the limbs 28 and surfaces 30, to hold the intermediate member 16 in position on the base 12.

Many other types of connection arrangement could be used to securely connect the intermediate members 16 to the base 12. Other types of hinge could also be used. In the example described above, it is preferred to provide the hinge between the intermediate member 16 and the side wall 14, with the attachments between the members 16 and the base 12 being detachable. However, it may in some circumstances be advantageous to provide the hinge between the member 16 and the base 12, with the members 16 and the corresponding walls 14 being attached by an arrangement similar to that shown, or any of the alternatives.

The containers shown in the drawings also incorporate a number of features which assist stacking. As has been described, the containers have a base 12 and side walls 14 with an erect condition and a collapsed condition. The container 10 further comprises stacking formations 34,36,38 and 40. Firstly, the side walls 14 have top edges (when erect) which are castellated to form notches 34. These overlie downward projections 36 from the base 12 so that a container base can be stacked on a container below when the lower container is in the erect condition, by lowering the base of the upper container until the base projections 36 on the upper container sit in the notches 34 in the lower container. The notches 34 and projections 36 then engage to stop the upper container sliding relative to the lower container. This assists secure stacking. One arrangement uses projections 36 which fit closely in corresponding notches 34. Alternatively, projections 36 could be shorter than the notches 34, so that one notch 34 prevents sliding in one direction, with another notch preventing sliding in the opposite direction.

In the arrangements shown, the locations of the notches 34 and projections 36 also allows containers to be stacked when rotated through 90°, there being three notches 34 and projections 36 along each longer side of the rectangular container, and two notches 34 and two projections 36 along each shorter side. When stacked in this way, the upper container will overhang the lower container by approximately one third of its length.

Figure 5:
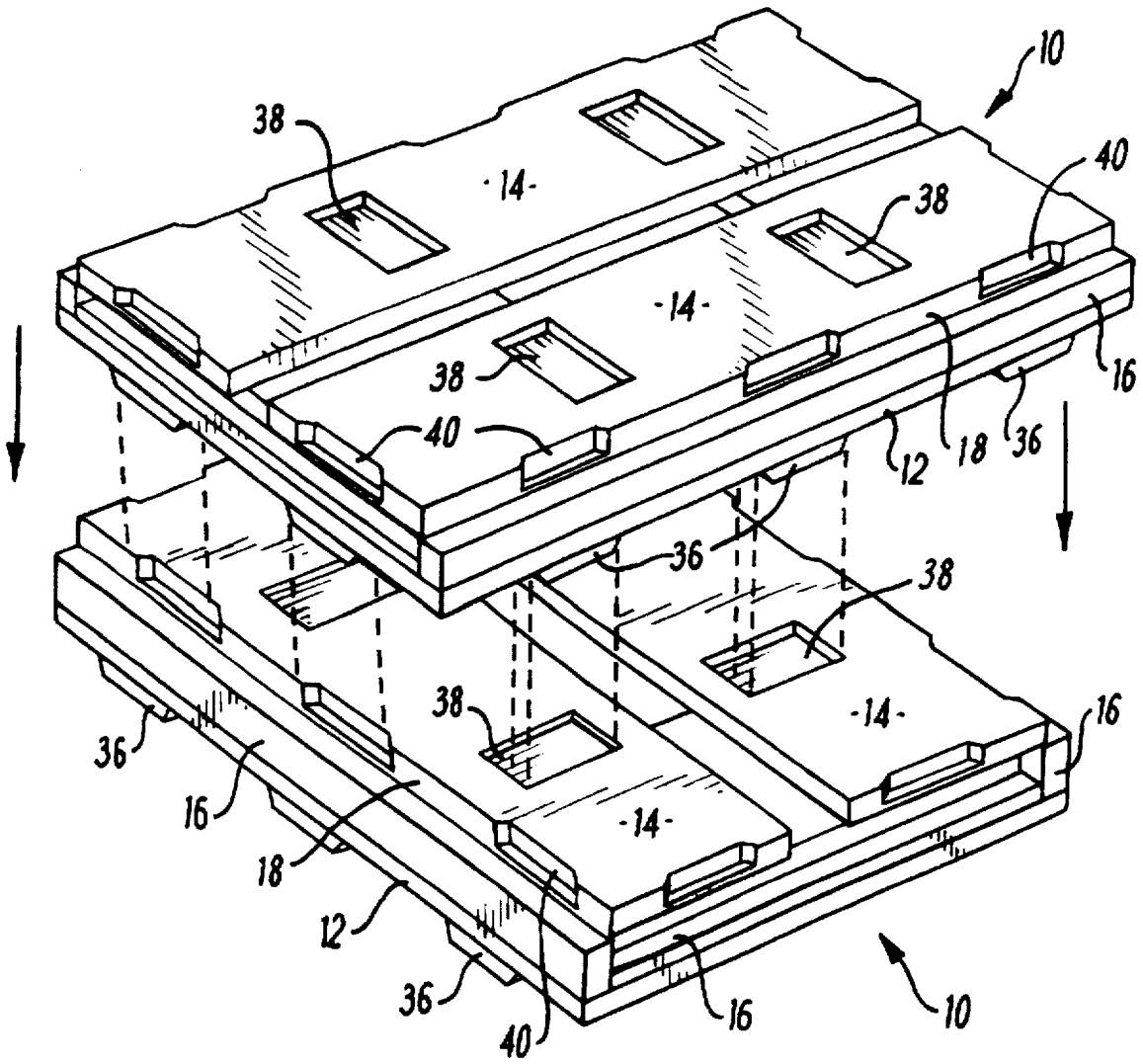
FIG. 5 shows the containers of FIG. 1 being stacked in the collapsed condition.

Secure stacking in which relative sliding is prevented can also be achieved when the lower container is in the collapsed condition. This is illustrated in FIG. 5. Two containers are shown there, both collapsed. Depressions 38 formed in the face of the side walls 14 now face upwardly by virtue of the collapsed condition of the containers. In addition, notches 40 around the edges of the walls 14, including notches along the edge 18, become exposed when the container is collapsed. The arrangement and form of these depressions and notches allows them to receive the projections 36 from a like container stacked from above. The arrangement allows stacking two containers in alignment, or at right angles to one another (as shown). When stacked at right angles, two projections 36 at the short side of the base 12 sit in two notches 40 at the lower edge of a longer wall 14 of the lower container, leaving a third notch 40 unoccupied. Two projections 36 on the base of the upper container sit in depressions 38, one in each of the longer walls 14 of the lower container. Another two projections 36 (obscured in FIG. 5) sit in notches at the obscured end of the walls 14. A corresponding two notches 40 at the visible end are unoccupied.

The spacing and sizes of the notches 34, projections 36, depressions 38, and notches 40 locate the upper container on the lower container to stop the stacked containers sliding relative to each other.

The ability to stack collapsed containers at right angles to one another facilitates the creation of a stable stack as will now be described with reference to FIG. 6. First, it should be noted that the depressions 38 are relatively wide, and allow two projections 36 to be located in them, side-by-side, one from each of two containers being stacked side-by-side on the same lower container.

Figure 6:
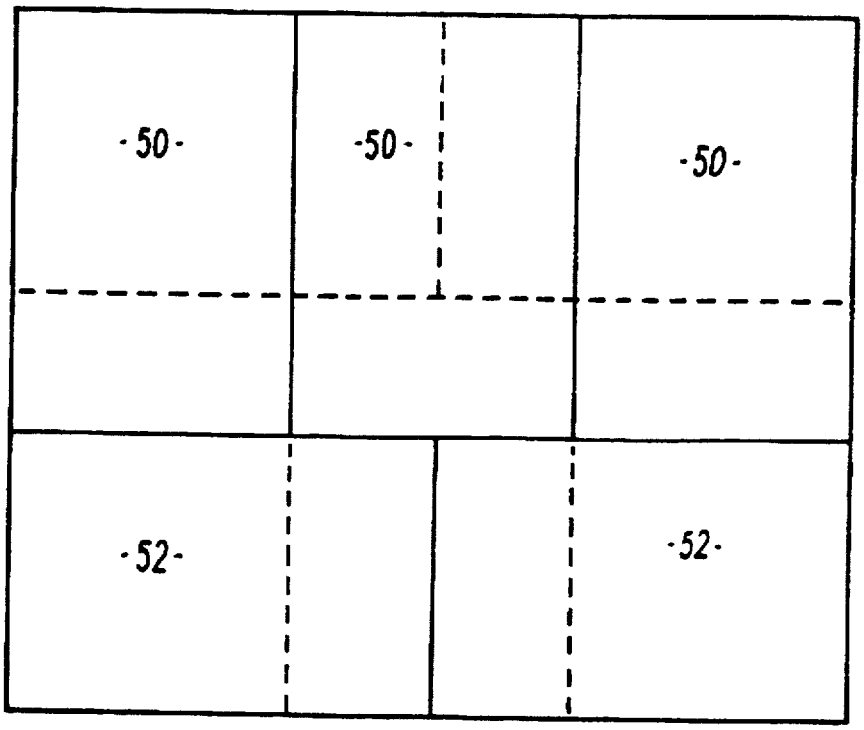
FIG. 6 is a schematic plan view of the stacking pattern of the containers of FIG. 5.

Turning to FIG. 6, a layer in a stack of collapsed containers is formed by five containers arranged as indicated by the solid lines. Three containers 50 have their long sides adjacent and their short sides aligned. Two more containers 52 are at right angles to the containers 50 with shorter sides abutting and longer sides adjacent the shorter sides of the containers 50. FIG. 6 also indicates the arrangement on the layer beneath, using broken lines. It can be seen that the arrangement is the same except that the whole layer has been rotated through a half turn. This results in every container overlying at least two containers on the layer below which, by virtue of the interconnecting notches, projections and depressions, yields a secure stack akin to the building of brickwork.

Containers of 600 mm×400 mm base can be stacked in the manner shown on a standard size pallet. Similar overlapping stacking arrangements can be devised for other container sizes, such as 400 mm×300 mm, again with similar advantages. The layout of the interlocking formations for the erect and collapsed containers would vary according to the size of container.

It will be apparent from the above description that many variations and modifications can be made without departing from the scope of the present invention. In particular, many different sizes of container could be designed, with corresponding arrangements of interlocking formations. Other hinge techniques could be used, as could alternative arrangements for attaching the intermediate members to the base. Alternatively, the intermediate member and the base could be hinged, with the wall being made separately. The containers have been described as being of plastics material, but other materials could be used. Lock arrangements could be incorporated to hold the container walls in the erect position.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A collapsible container comprising a base, at least one side wall which may move to a stowed position when the container is not in use, an intermediate member, hinge means connecting the intermediate member with a first one of the side wall and the base, and attachment means operable to releasably attach the intermediate member to a second one of the side wall and the base, the intermediate member and the second one of the side wall and the base being manufactured separately, and subsequently assembled by means of the attachment means; the attachment means comprising a hook formation for introduction into a recess in a first direction, movement in a second direction serving to engage the hook with the walls of the recess, thereby locking the hook and recess together.

2. A container according to claim 1, wherein the intermediate member extends along substantially the whole length of the side wall.

3. A container according to claim 1 or 2, wherein the intermediate member is located below the lower edge of the side wall, in use.

4. A container according to claim 1, further comprising detent means operable to retain the cooperating formations together.

5. A container according to claim 4, wherein the detent means snap together.

6. A container according to claim 1, wherein the different directions are perpendicular.

7. A container according to claim 1, wherein the attachment means incorporate resilience for retaining the attachment means in the attached condition.

8. A container according to claim 1, wherein the hinge means comprise a live hinge.

9. A container according to claim 1, wherein the hinge means connects the intermediate member with the side wall, and the attachment means attaches the intermediate member to the base.

10. A container according to claim 1, wherein the base has rectilinear shape and the container comprises four side walls as aforesaid, and corresponding intermediate members connected and attached as aforesaid.

11. A container according to claim 1, wherein the walls fold over the base when the container is collapsed.

12. A container according to claim 1, wherein the container comprises stacking formations able to interlock with corresponding formations on a like container when the containers are in the erect or collapsed condition and are stacked one on the other, the stacked containers being substantially prevented from relative movement by the interlocking of the stacking formations.

13. A collapsible container comprising a base, and side walls having an erect condition and a collapsed condition, the container further comprising stacking formations able to interlock with corresponding formations on a like container when the containers are in the erect or collapsed condition and are stacked one on the other, the formations interlocking when the containers are stacked in a plurality of relative orientations, said relative orientations being 90 degrees to each other, said formations being located such that said formations will be able to interlock when said containers are in any of said plurality of relative orientations, and the stacked containers being substantially prevented from relative movement by the interlocking of the stacking formations, thereby allowing a plurality of containers, of a plurality of relative orientations, to form a secure stack.

14. A container according to claim 13, wherein the side walls are connected to the base by hinge means.

15. A container according to claim 13 or 14, wherein the side walls lie across the base when in the collapsed condition.

16. A container according to claim 13, wherein the stacking formations comprise projections and recesses.

17. A container according to claim 13, wherein the stacking formations are arranged to prevent containers sliding one on the other when stacked.

18. A container according to any of claim 13, wherein the stacking formations comprise castellations along wall edges which are uppermost when the container is in the erect condition.

19. A container according to claim 18, wherein the recesses or depressions are exposed from above when the container is in the collapsed condition, to receive castellations formed on the base of a like container.

20. A container according to any of claim 13, wherein the stacking formations comprise castellations located along the lower face of the base.

21. A container according to any of claim 13, wherein the stacking formations comprise recesses or depressions in the face and/or edges of the walls.

22. A container according to claim 13, wherein the orientations are at right angles to each other.

23. A container according to claim 13, wherein the side walls are movable to the collapsed condition when the container is not in use.

24. A container according to claim 13, comprising an intermediate member, hinge means connecting the intermediate member with one of the side wall and the base, and attachment means operable to attach the intermediate member to the other of the side wall and the base, the intermediate member and the said other of the side wall and the base being manufactured separately and subsequently assembled by means of the attachment means.

* * * * *